US006591470B2

(12) United States Patent
Palmer, II

(10) Patent No.: US 6,591,470 B2
(45) Date of Patent: Jul. 15, 2003

(54) METHOD AND APPARATUS FOR RAPIDLY PLUGGING A LEAK FROM A CONTAINER

(75) Inventor: Buren T. Palmer, II, Walker, LA (US)

(73) Assignee: Trident Technologies Corporation, Denham Springs, LA (US)

( * ) Notice: Subject to any disclaimer, the term of this patent is extended or adjusted under 35 U.S.C. 154(b) by 172 days.

(21) Appl. No.: 09/897,587

(22) Filed: Jul. 2, 2001

(65) Prior Publication Data

US 2002/0000697 A1 Jan. 3, 2002

Related U.S. Application Data

(63) Continuation-in-part of application No. 09/767,503, filed on Jan. 23, 2001.

(60) Provisional application No. 60/215,842, filed on Jul. 3, 2000, and provisional application No. 60/225,726, filed on Aug. 16, 2000.

(51) Int. Cl.[7] ..... B23P 6/00

(52) U.S. Cl. ..... 29/402.09; 277/312; 277/630; 114/227; 29/402.07; 29/402.01

(58) Field of Search ..... 29/402.09, 402.02, 29/402.01, 402.14, 402.16, 402.08, 407.09, 559; 114/227, 228, 229; 277/312, 316, 630

(56) References Cited

U.S. PATENT DOCUMENTS

| | | | |
|---|---|---|---|
| 4,527,500 | A | 7/1985 | Fuerst |
| 4,569,303 | A | 2/1986 | McDuff et al. |
| 4,953,491 | A | 9/1990 | Zaitoun |
| 5,025,972 | A | 6/1991 | Finlan |
| 5,036,786 | A | 8/1991 | Uri |
| 5,072,684 | A | 12/1991 | Pryor |
| 5,165,356 | A | 11/1992 | Williams |
| 5,253,602 | A | 10/1993 | Moriarty |
| 5,355,824 | A | 10/1994 | Meyer et al. |
| 5,361,555 | A | 11/1994 | Walker |
| 5,685,252 | A | 11/1997 | Prysner |
| 5,735,227 | A | 4/1998 | Goulding |
| 5,927,223 | A | 7/1999 | Meyer |

OTHER PUBLICATIONS

"It's Been _", by G&G Technical Services Ltd. ggtech website, p. 4, 2 sheets, printed Jun. 1, 2001.

The "Sea Patch", by G&G Technical Services Ltd., website, 6 pages, pp. 26, 27 and 28, printed Jun. 1, 2001.

*Primary Examiner*—Gregory Vidovich
*Assistant Examiner*—Stephen Kenny
(74) *Attorney, Agent, or Firm*—Geoffrey A. Mantooth

(57) ABSTRACT

A framework of magnet pods and beams or strongbacks can be quickly and easily assembled to plug a leak in a ferromagnetic container wall. The magnet pods are located on either side of the leak. One or more beams extend between the magnet pods. Each magnet pod has a yoke with plural holes therethrough. The yoke loosely receives the beam. Each beam has lines of holes therethrough all along the beam length. The plurality of holes in the yokes and beams simplifies the alignment of at least one set of holes between the yoke and beam, wherein a pin is inserted to couple the beam to the magnet pod. A clamp is pinned to the beam so as to be adjacent to the leak. The clamp is tightened to exert removable pressure on a patch over the leak.

28 Claims, 12 Drawing Sheets

METHOD AND APPARATUS FOR RAPIDLY PLUGGING A LEAK FROM A CONTAINER

CROSS-REFERENCE TO RELATED APPLICATIONS

This application is a continuation-in-part application of Ser. No. 09/767,503, filed Jan. 23, 2001. This application claims the benefit of provisional applications Serial No. 60/215,842, filed Jul. 3, 2000 and Serial No. 60/225,726, filed Aug. 16, 2000, the disclosures of which are incorporated by reference herein.

FIELD OF THE INVENTION

The present invention relates to methods and apparatuses for plugging leaks in containers, such as ships, vessels, etc.

BACKGROUND OF THE INVENTION

Tanker ships are used to carry liquid cargo such as petroleum products. Many tankers are of single hull construction, wherein only a single layer of steel plating separates a cargo tank from the water surrounding the hull. Consequently, any breach of the hull at a tank results in spillage in some of the liquid cargo.

Leakage of petroleum products or industrial chemicals into a body of water such as a bay can cause environmental damage. Large catastrophic spills off of shorelines receive much public attention. However, there is a far greater number of small spills. These small spills are of an environmental concern as well.

When a leak occurs, the objective is to stop the leak as quickly as possible. Speed is of the essence because the longer the leak occurs, the larger the quantity of hazardous material that enters the environment.

There exists in the prior art devices that are used for plugging a leak. These devices are shown in Meyer U.S. Pat. Nos. 5,355,824 and 5,927,223. These devices attach a framework to the ferromagnetic hull by magnets. A rubber plug is inserted into the opening or a bladder is laid over the opening. The framework is used to restrain the plug or bladder in place, thus sealing the opening.

The problem with these prior art devices is the relative difficulty of assembling the framework and positioning it over the leak or opening. This difficulty adds to the time that it takes to stop the leak. What is needed is a framework that is quick and easy to assemble and position.

SUMMARY OF THE INVENTION

It is an object of the present invention to provide a method and apparatus for rapidly stopping a leak in a container.

It is another object of the present invention to provide a framework for holding a patch for a seal in place over an opening in a container, which framework can be quickly assembled and positioned.

The present invention provides an apparatus for use in stopping a leak in a ferromagnetic wall of a container. The apparatus comprises at least two magnet pods, a beam and a clamp. Each magnet pod comprises a magnet having a surface that is structured and arranged for contacting the container wall. There is also a member rotatably coupled with the magnet. The member has plural holes therethrough. The beam has holes therethrough. The beam is coupled to each of the members when one of the holes of the respective one of the members aligns with one of the holes of the beam so as to receive a pin through the aligned holes. The clamp has a foot and is coupled to a selected location along the length of the beam. The position of the foot with respect to the beam is adjustable so as to apply clamping pressure to the wall when the apparatus is installed on the wall.

In accordance with one aspect of the present invention, the member comprises a yoke having plural holes therethrough.

In accordance with another aspect of the present invention, the yoke is coupled with the magnet such that the yoke can rotate and roll with respect to the magnet.

In accordance with still another aspect of the present invention, the beam is rectangular in transverse cross-section and has four sides, with each side having a line of holes therein. The holes on one side are aligned with the holes on the opposite side.

In accordance with still another aspect of the present invention, the beam comprises first and second beams, with each of the first and second beams having two ends. One of the ends of the first beam is coupled to one of the ends of the second beam with a rigid coupling.

In accordance with still another aspect of the present invention, the rigid coupling is "U" shaped having a main portion and sides extending from the main portion, with the sides having holes therethrough for receiving the pins.

In accordance with still another aspect of the present invention, the beam comprises first and second beams, with each of the first and second beams having two ends. One of the ends of the first beam is coupled to one of the ends of the second beam with an adjustable coupling wherein the angle between the first and second beams can be adjusted.

In accordance with still another aspect of the present invention, the adjustable coupling comprises first and second end pieces with the first end piece being coupled to one of the ends of the first beam and the second end piece being coupled to one of the ends of the second beam, with the first and second pieces each comprising a plate having a pivot hole and an arc of holes. The plates are pivotally coupled together at the pivot holes, wherein at least one hole in the arc of holes of one plate is aligned with at least one hole in the arc of holes of the other plate and a pin coupling can be inserted through the aligned holes. The pin coupling can be a bolt, etc.

In accordance with another aspect of the present invention, the beam is a first beam. The first beam has an intermediate portion. The apparatus further comprises a second beam having two ends, with one of the ends of the second beam being coupled to the intermediate portion of the first beam with an adjustable coupling, wherein the angle between the first and second beams can be adjusted. The other of the ends of the first beam is coupled to a third magnet pod.

In accordance with another aspect of the present invention, the adjustable coupling comprises first and second pieces, with the first piece being pivotally coupled to the intermediate portion of the first beam and the second piece being coupled to one of the ends of the second beam, with the first and second pieces being pivotally coupled together.

In accordance with another aspect of the present invention, the apparatus further comprises a patch, the patch comprising a rigid member and an elastomeric member, the rigid member having a plurality of depressions for receiving the foot of the clamp.

The present invention also provides an apparatus for use in stopping a leak in a ferromagnetic wall of a container comprising at least two magnet pods, first and second beams and a clamp. Each magnet pod comprises a magnet having a surface that is structured and arranged for contacting the container wall and a member rotatably coupled to the magnet. Each of the first and second beams has two ends. One of the ends of the first beam is coupled to one of the magnet pods and one of the ends of the second beam is coupled to another of the magnet pods. The first and second beams are coupled together. The clamp has a foot and is coupled to a selected location along the length of one of the first or second beams. The position of the foot with respect to one of the first or second beams is adjustable so as to apply clamping pressure to the container wall when the apparatus is installed on the container wall.

In accordance with one aspect of the present invention, the other of the ends of the first beam is coupled to the other of the ends of the second beam with a rigid coupling.

In accordance with still another aspect of the present invention, the first and second beams have holes therethrough for receiving pins. The rigid coupling is "U" shaped having a main portion and sides extending from the main portion, with the sides having holes therethrough for receiving the pins.

In accordance with still another aspect of the present invention, the other of the ends of the first beam is coupled to the other of the ends of the second beam with an adjustable coupling.

In accordance with still another aspect of the present invention, the first and second beams have holes therethrough for receiving pins. The adjustable coupling comprises first and second end pieces with the first end piece being coupled to the other of the ends of the first beam and the second end piece being coupled to the other of the ends of the second beam. The first and second ends pieces each comprise a plate having a pivot hole and an arc of holes. The plates are pivotally coupled together at the pivot holes, wherein at least one hole in the arc of holes of one plate is aligned with at least one hole in the arc of holes of the other plate.

In accordance with still another aspect of the present invention, the other of the ends of the second beam is coupled to an intermediate portion of the first beam with an adjustable coupling. The other of the ends of the first beam is coupled to a third magnet pod.

In accordance with still another aspect of the present invention, the adjustable coupling comprises first and second pieces, with the first piece being pivotally coupled to the intermediate portion of the first beam and the second piece being coupled to one of the ends of the second beam. The first and second pieces are pivotally coupled together.

The present invention also provides a method of stopping a leak in a ferromagnetic wall of a container. At least two magnet pods are provided, with each magnet pod having a member extending therefrom, each member having plural holes therethrough. A beam is provided, which beam has plural holes therethrough. The beams holes are located along a length of the beam. One of the magnet pods is contacted with the container wall on one side of the leak and another of the magnet pods is contacted with the container wall on another side of the leak. The beam is placed between the magnet pods. At each magnet pod, aligning at least one of the holes in the respective member with at least one of the holes in the beam and inserting a pin through the aligned holes to couple the beam to the respective magnet pod. An extendable arm is coupled to the beam. The extendable arm having a foot thereon, with the foot being located adjacent to the leak. A patch is located on the leak. The arm is extended from the beam so that the foot applies pressure to the patch.

In accordance with one aspect of the present invention, the beam is constructed from first and second beams that are coupled together in an end-to-end manner with a rigid coupling.

In accordance with another aspect of the present invention, the beam is constructed from first and second beams that are coupled together in an end-to-end manner with an adjustable angle coupling.

In accordance with still another aspect of the present invention, the beam is constructed from first and second beams with the end of the second beam being pivotally coupled to an intermediate portion of the first beam. The second beam is coupled to one of the magnet pods and the first beam is coupled to two other of the magnet pods on either side of the intermediate portion.

The present invention also provides an apparatus for use in stopping a leak in a ferromagnetic wall of a container. The apparatus comprises at least two magnet pods, a beam, and a clamp. Each magnet pod comprises a magnet having a surface that is structured and arranged for contacting the container wall. The magnet pod also comprises a member rotatably coupled with the magnet. The member has two spaced apart wall surfaces. The beam comprises two end portions. Each end portion has two spaced apart wall surfaces. Each of the end portions of the beam are removably coupled to a respective one of the magnet pod members at a connection. At each connection, either one of the member wall surfaces or the beam end portion wall surfaces have a cavity therebetween for receiving the other of the member wall surfaces or the beam end portion wall surfaces. At each connection, either of the member wall surfaces or the beam end portion wall surfaces have plural sets of holes therethrough, with the other of the member wall surfaces or the beam end portion wall surfaces having at least one set of holes therethrough. The member and the beam end portion are coupled together by a pin extending through aligned holes in the member and the beam end portion. The clamp is threadingly coupled to the beam at a location that is between the magnet pods. The clamp is rotatably coupled to a foot. The foot is structured and arranged to contact a patch.

In accordance with one aspect of the present invention, the member comprises a transverse wall that couples the member wall surfaces together.

In accordance with another aspect of the present invention, the beam end portions each comprise a transverse wall that couples the beam end portion wall surfaces together.

In accordance with still another aspect of the present invention, the beam has three end portions extending from a center portion. The clamp is threadingly coupled to the center portion.

In accordance with still another aspect of the present invention, the clamp is threadingly coupled to the beam at a fixed location along the beam.

In accordance with still another aspect of the present invention, the clamp is threadingly coupled to the beam at an adjustable location along the beam.

DESCRIPTION OF THE PREFERRED EMBODIMENTS

Figure 1:
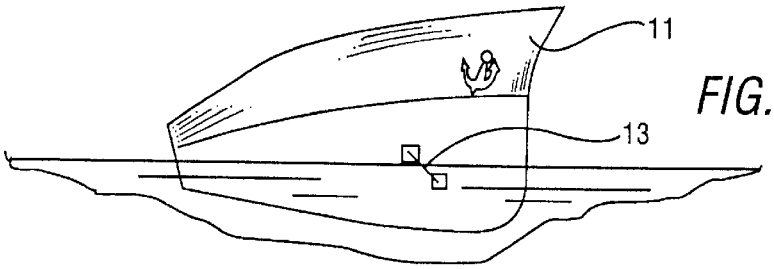
FIG. 1 is a schematic view of a ship's hull, showing the apparatus of the present invention, in accordance with a preferred embodiment, installed thereon.

In FIG. 1, there is shown a schematic view of a ship's hull 11. The ship is capable of carrying liquid cargo (such as crude oil). The hull of the ship has developed a leak or breach to the outside environment. The cause of the leak could be corrosion, impact, or some other mechanism. The ship could be a tanker with multiple tanks therein.

If a tank has been punctured, some of the contents of the tank leak out into the environment. As even a small amount of the contents could damage the environment around the ship, it is desirable to patch or plug the leak as quickly as possible in order to minimize the amount of cargo that is spilled.

Figure 2:
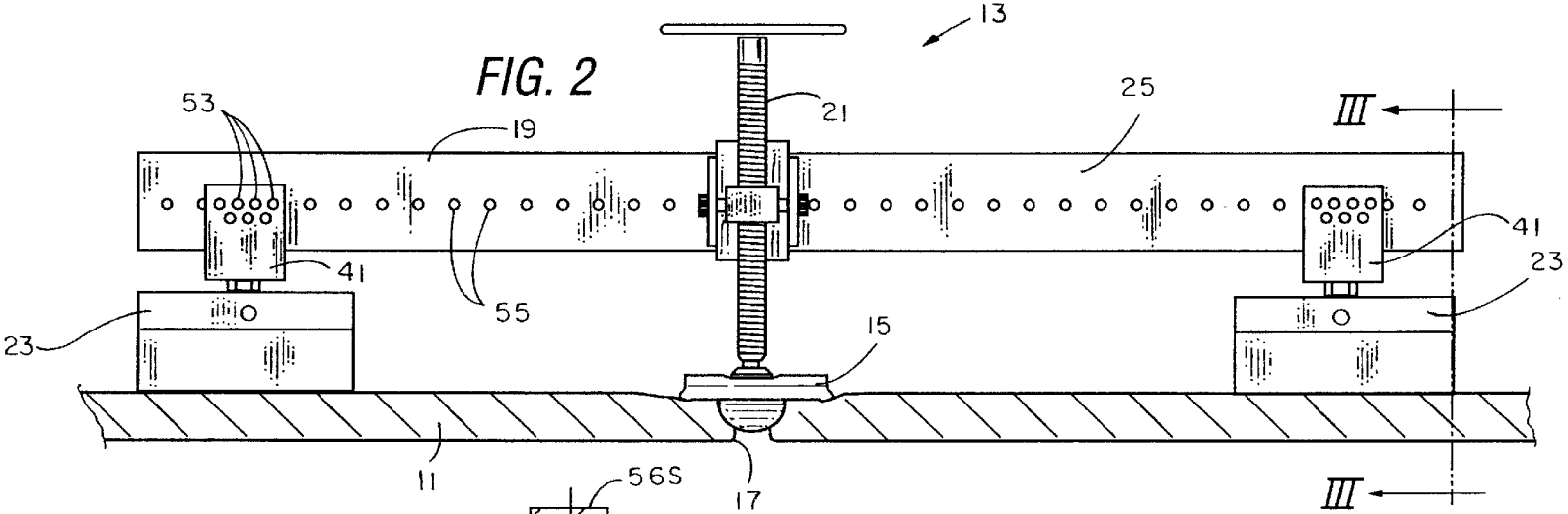
FIG. 2 is an elevational view of the apparatus, utilizing a single strongback.

Referring to FIG. 2, the present invention provides an apparatus 13 that can quickly apply a patch 15 to the leak 17 in the hull 11. The patch 15 is either inserted into the opening (as a plug) or is laid over the opening. The apparatus 13 has a clamp 21 that secures the patch in place. The clamp 21 is coupled to a framework 19, which in turn is coupled to the ship's hull by way of several magnet pods 23, which contain strong magnets (the hull is ferromagnetic).

The framework 19 is designed to be easily set up. Typically, the framework 19 is set up before the patch 15 is placed over the leak. To set up the framework, the magnet pods 23 are placed on the hull 11 on opposite sides of the leak 17. Then one or more strongbacks 25 are placed so as to bridge or span across the magnet pods 23. The magnet pods 23 are coupled to the strongback 25 by way of pins 27 (see FIG. 3). The strongback 25 can be quickly adjusted with respect to the magnet pods 23 so as to allow the insertion of the pins 27 therethrough. This eliminates the need to move the magnet pods on the hull, which is a difficult and time consuming task because of the great attractive force between the magnets and the ship's hull. After the strongback 25 is coupled to the magnet pods, the framework 19 is complete. Then one or more clamps 21 are coupled to the strongback 25 and the patch 15 is placed over the leak 17. The patch 15 is secured by the clamp or clamps 21.

The elastomeric patch 19 should be closed cell (if a foam), resistant to crude oil and other hydrocarbons and of a relatively soft to medium durometer. The patch should also be thick. The combination of a thick patch and relatively soft to medium durometer allows the patch to cover irregular shapes and projections.

The apparatus and method of the present invention can be used to stop or plug a leak in any type of container having a ferromagnetic wall. Such containers include ships, tanks, pipelines and rail car tanks.

The apparatus 13 will now be described in more detail. Referring to FIG. 2, the apparatus 13 includes one or more magnet pods 23, one or more strongbacks 25 and one or more clamps 21.

Figure 3:
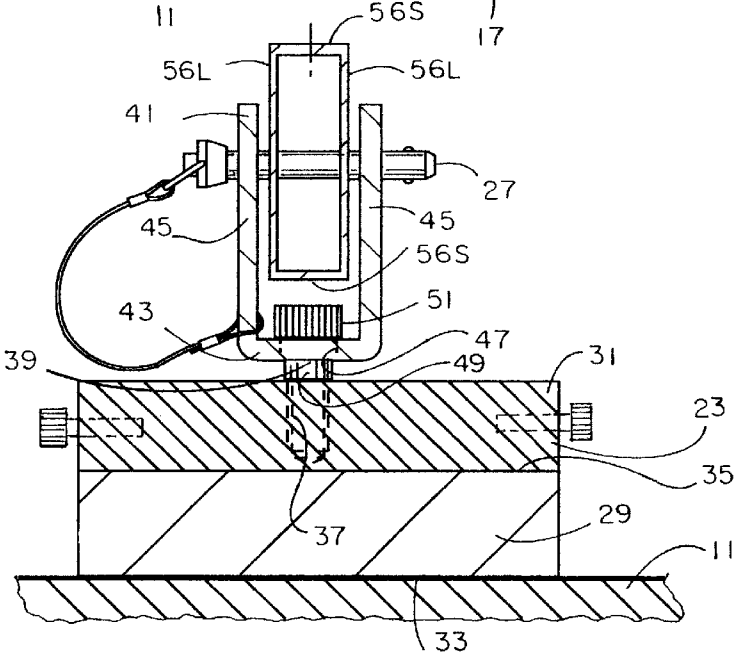
FIG. 3 is a cross-sectional view of one of the magnet pods, taken through lines III—III of FIG. 2.

Referring to FIGS. 2 and 3, each magnet pod 23 includes a magnet 29 and a block 31. The magnet 29 is of a rare earth type, so as to produce a strong magnetic field for coupling to the vessel. As shown in the figures, the magnet is rectangular in shape, but need not be so. The magnet 29 has a first side 33 that is flat for contacting the vessel wall and a second side for receiving a mounting device in the form of the block 31 or plate. The block 31 is not magnetic (being aluminum in the preferred embodiment). Holes are drilled through the block, which align with tapped holes in the magnet. The block 31 is coupled to the magnet 29 by way of cap screws extending through the block into the magnet; the heads of the cap screws are accessible from the top of the block.

In the preferred embodiment, and referring to the orientation of FIG. 3 where the side 33 is the bottom, the top and sides of the magnet 29 and block 31 assembly are covered by an elastomeric boot (not shown) for protection. The sides and the bottom of the magnet are covered in a protective sheath such as magnetic stainless steel for corrosion resistance and to maintain the appearance of the magnet. Other materials can be used to cover the magnet, such as brass and a plastic, however care should be taken to minimize the thickness of nonmagnetic coverings so as to minimize the gap between the magnet and the wall when in use.

In the center of the block 31 is a drilled and tapped hole 37, which receives a shoulder bolt 39. A "U" shaped yoke 41 is mounted to the block 31 by way of the shoulder bolt 39. The yoke 41 has a main portion (or bight) 43 and sides 45 that extend out from the main portion. At the main portion of the "U" shaped yoke is an opening 47 having a diameter that is much larger than the diameter of the shoulder portion 49 of the bolt 39, yet is smaller than the diameter of the bolt head 51. Thus, the yoke 41 is loosely mounted to the block 31 and can rotate 360°. The loose mounting also allows the yoke 41 to rock (or roll) to either side to assist in the assembly of the framework. (For example, referring to the orientation of FIG. 3, the yoke 41 can roll from side to side.) The two sides 45 of the yoke have plural holes or openings 53 therein. In the preferred embodiment, there are two rows (upper and lower) of holes 53, with each row having plural holes therein. The holes on one side 45 of the yoke 41 are aligned with the holes on the other side 45 of the yoke. In addition, the strongback 25 fits loosely into the yoke.

Each strongback 25 is a rigid beam having plural holes therethrough. In the preferred embodiment, each strongback is a rectangular hollow beam. Each four sided strongback has a line of holes 55 in each side (see for example FIG. 10). The holes on opposite sides are aligned with each other so that a pin 27 can be inserted through the strongback (as shown in FIG. 3). Preferably, the strongbacks are made of aluminum or some other nonmagnetic material.

Figure 4:
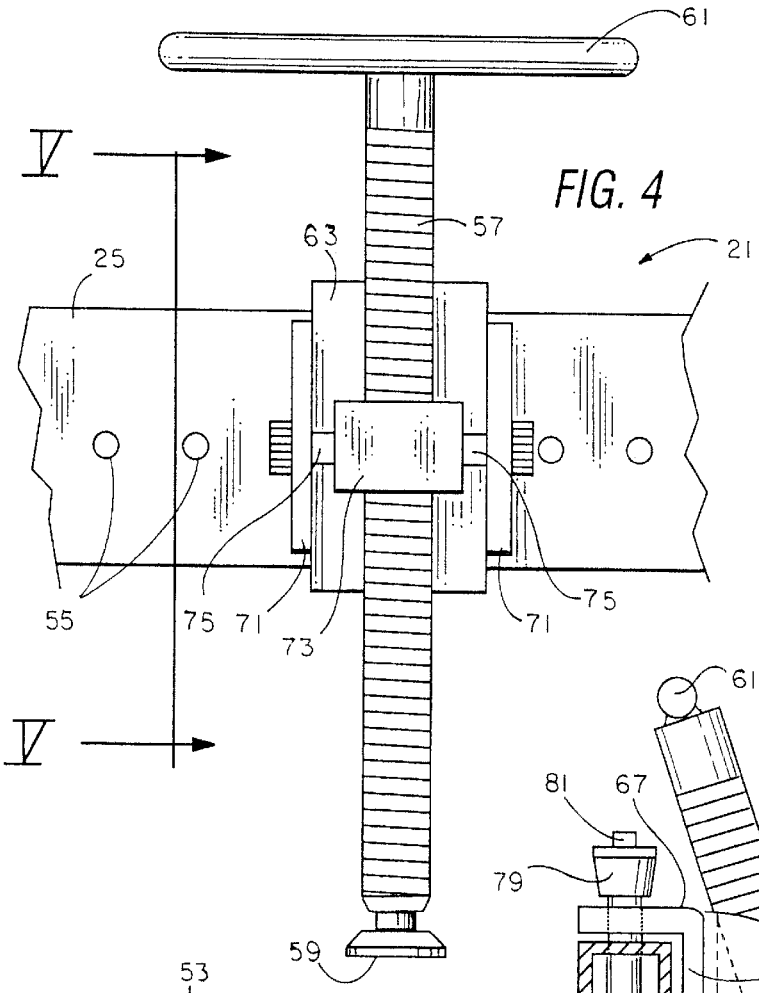
FIG. 4 is an elevational, close-up view of the clamp assembly of FIG. 2.
Figure 5:
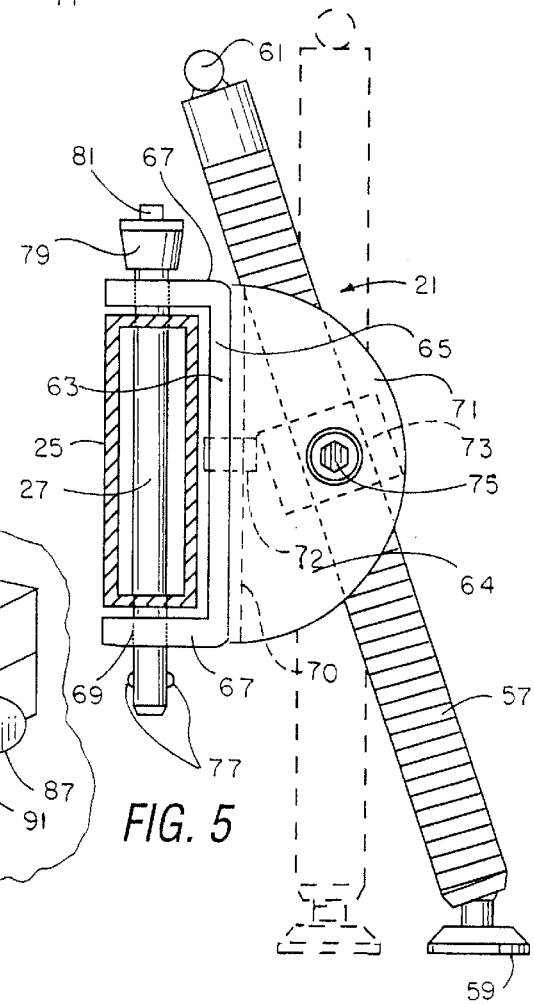
FIG. 5 is a cross-sectional view, taken through lines V—V of FIG. 4.

Referring to FIGS. 4 and 5, the clamp 21 is a threaded rod 57 mounted to the strongback 25. At one end of the threaded rod 57 is a pivotable, rotatable foot 59. At the other end of the threaded rod 57 is a bar 61 mounted perpendicular to the rod so as to form a handle. The handle 61 can be "L" shaped with one leg extending relatively up in the orientation shown in FIG. 19. The vertical leg is used to quickly spin the rod 57.

The strongback coupling for the threaded rod 59 are two "U" shaped yokes 63, 64 pivotally coupled together back to back. One yoke 63, when oriented to the strongback as shown in FIG. 5, has a main portion 65, and sides 67. The sides 67 each have a hole 69 therethrough. The holes 69 in the sides 67 are aligned with one another so as to receive a pin 27. Extending out from the main portion 65 in an opposite direction to the sides 67 is the other "U" shaped yoke 64 with a main portion 70 having plates or sides 71 that are perpendicular in orientation to the sides 67. The yoke 64 with the plates 71 is rotatably coupled to the main portion 65 of the yoke 63 by way of a swivel coupling 72. Thus, referring to the orientation of FIG. 4, the yoke with the plates 71 and the threaded rod 57 can rotate clockwise or counter-clockwise with respect to the strongback 25. A threaded block 73 with a threaded opening therethrough is received between the plates 71. The block 73 is pivotally coupled to the plates 71 by bolts 75. As shown in FIG. 5 by the dashed lines the threaded rod 57 can pivot in the plates 71. In addition, the threaded rod 57 can be rotated within the block 73 so as to extend or retract the foot relative to the block 73 and the strongback 25.

The assembly and use of the apparatus of FIGS. 2–5 will now be described. When a leak in a container is located, a magnet pod 23 is located on each side of the leak. For example, on a ship's hull, one magnet pod could be placed forward of the leak, with the other magnet pod being placed aft of the leak. The magnet pods 23 are positioned so that the magnet surface 33 contacts the ship's hull 11 and the yoke 41 extends outwardly from the hull. Then, the strongback 25 is laid across the magnet pods. The yokes 41 are turned so as to receive the strongback 25 between the sides 45. The holes 53 in the yoke 41 are aligned with the holes 55 in the strongback 25 and a retaining pin 27 is inserted there-through. The provision of a number of holes 53 in the yoke 41 and a number of holes 55 in the strongback, the loose fit of the yoke 41 on the magnet pod 23 and the loose fit of the strongback 25 within the yoke 41 assist in aligning at least one set of holes in the yoke with a set of holes in the strongback, thereby easing the insertion of the pin through both the yoke and the strongback. The installer need not spend much time and effort moving the components to align the holes.

The retaining pin 27 is conventional and commercially available. Referring to FIG. 5, the retaining pin 27 has balls 77 at one end. The balls normally extend out as shown in FIG. 5. The other end has a stopper 79 and a push button 81. The button 81 is pushed so as to allow the balls 77 to retract and allow the insertion or removal of the pin 27 through the holes or openings of the yoke and strongback. The retaining pin 27 can be tethered to the yoke with a cable as shown in FIG. 3 so that the pins will not become lost.

Once the framework 19 (the magnet pods 23 and the strongback 25) has been assembled across the leak, the clamp 21 is coupled to the strongback 25. The clamp yoke 63 receives the strongback between the sides 67. The clamp is positioned over or adjacent to the leak and then the holes 69 in the clamp yoke 63 are aligned with the respective holes 55 in the strongback. A retaining pin 27 is inserted through the aligned holes to secure the coupling to the strongback.

A patch 15 is placed into or over the leak and the threaded rod 57 is pivoted so that the foot 59 is located over the patch. The threaded rod is rotated so as to press on to the patch. The patch is compressed sufficiently so as to stop the leak.

The apparatus 13 provides a temporary patch that allows the container to be emptied. Once emptied, the apparatus can be removed and a permanent patch can be fixed in place.

The strongback 25 has, referring to FIG. 3, two long sides 56L and two short sides 56S. The strongback is oriented to the hull 11 so that the short sides 56S are parallel to the hull. In the preferred embodiment, the pins 27 for the magnet pods 23 are parallel to the hull, while the pins for the clamps 21 are perpendicular to the hull.

The framework can be assembled and installed onto flat or curved surfaces. The apparatus can be utilized on a variety of ferromagnetic vessels and containers such as ships, barges, tanks, pipelines, etc.

Figure 6:
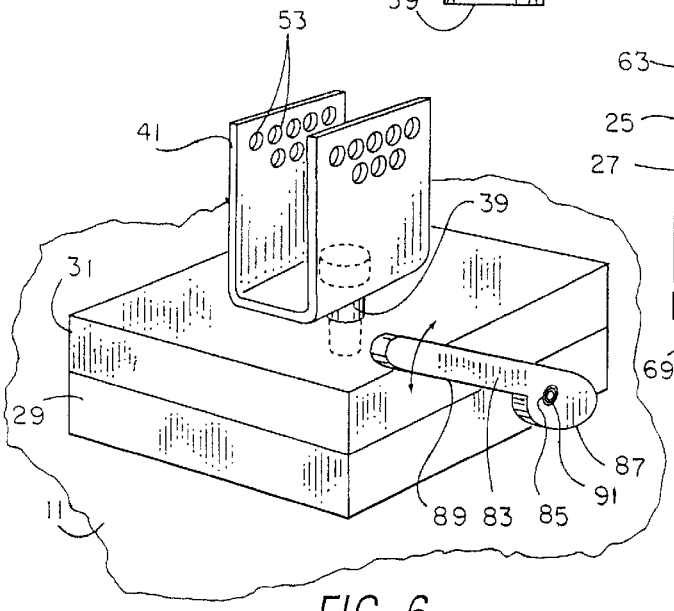
FIG. 6 is an isometric view showing a camming tool in the removal of a magnet pod from a vessel wall.

The apparatus 13 is removed using the reverse of the procedure described above. To remove the magnet pods 23 from the container wall 11, a camming tool 83 is used, as shown in FIG. 6. The camming tool 83 has two ends. At one end is a circular opening 85 and a cam surface 87 that extends over 180° around the opening 85. The distance between the opening 85 and the cam surface 87 increases as the cam surface extends towards the end of the tool. The other end of the tool forms a handle 89.

The magnet pod 23 has a bolt 91 extending out of two sides opposing of the block 31, as shown in FIG. 3. A portion of the shank of the bolt 91 is exposed. The camming tool 83 is slipped onto the bolt so that the opening 85 receives the bolt 91, as shown in FIG. 6. As the handle 89 is raised up in the orientation shown in FIG. 6, the camming surface 87 is brought into contact with the container wall 11. This pries up the magnet 29 from the container wall, and allows removal of the magnet pod 23. The other magnet pod is removed in a similar fashion.

Figure 18:
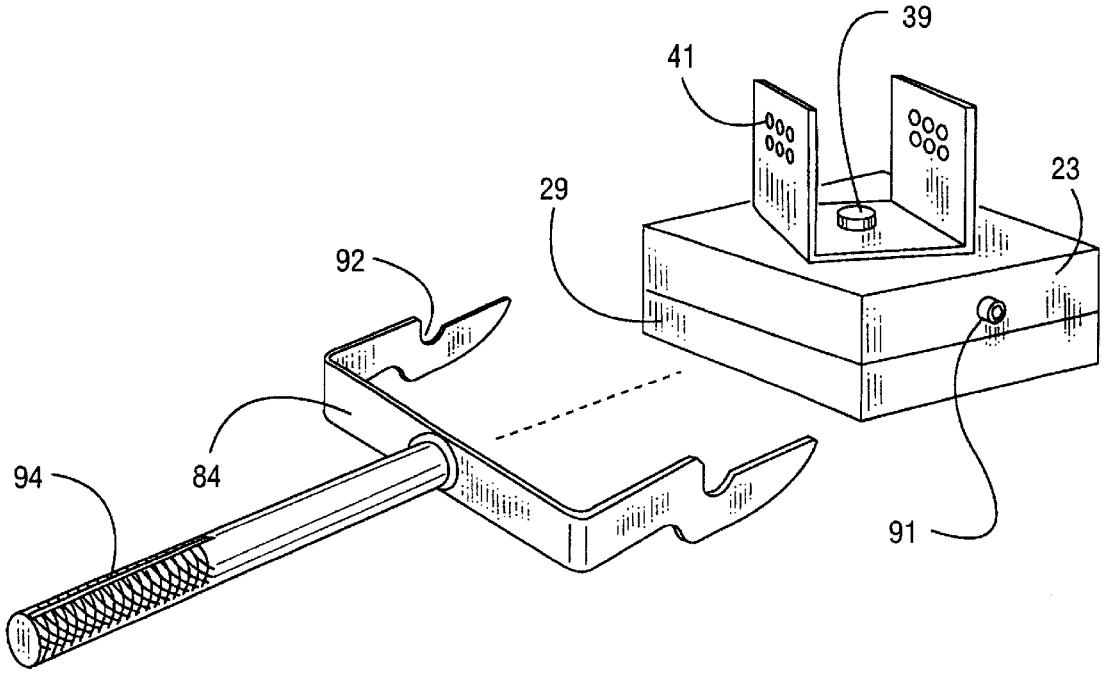
FIG. 18 is an isometric view of a camming tool used to pry off the magnet pods.

Alternatively, a yoke camming tool 84, shown in FIG. 18, is used to engage both bolts 91 on notches 92. When the handle 94 is raised, the magnet 29 is pried off of the container wall.

The apparatus 13 of FIGS. 2–6 is quite suitable for a small leak on a relatively flat section of vessel. The strongback 25 can be several feet in length.

Figure 14:
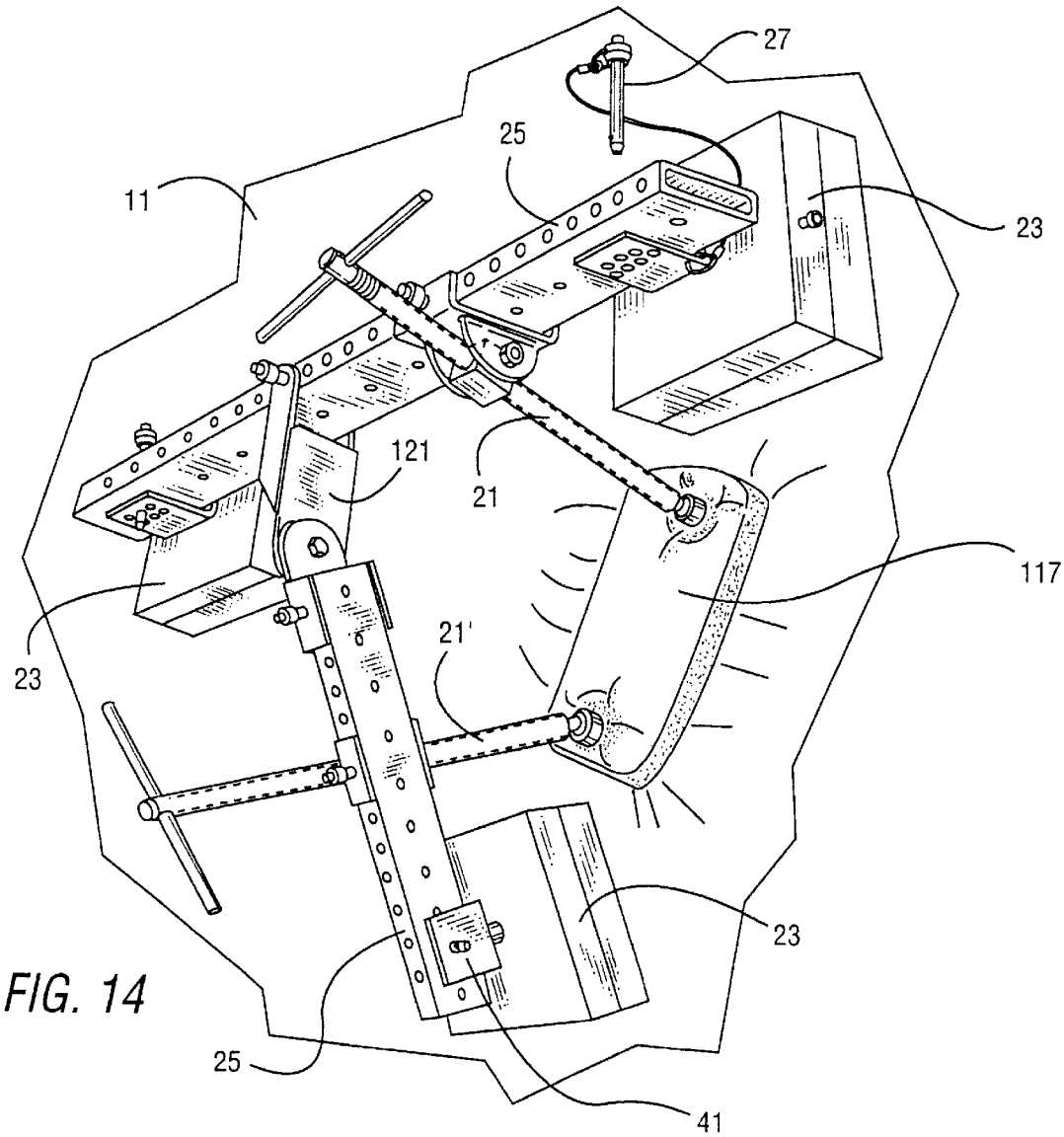
FIG. 14 shows another application of the apparatus of the present invention, using a "T" framework configuration, with the adjustable end-to-intermediate coupling.
Figure 12:
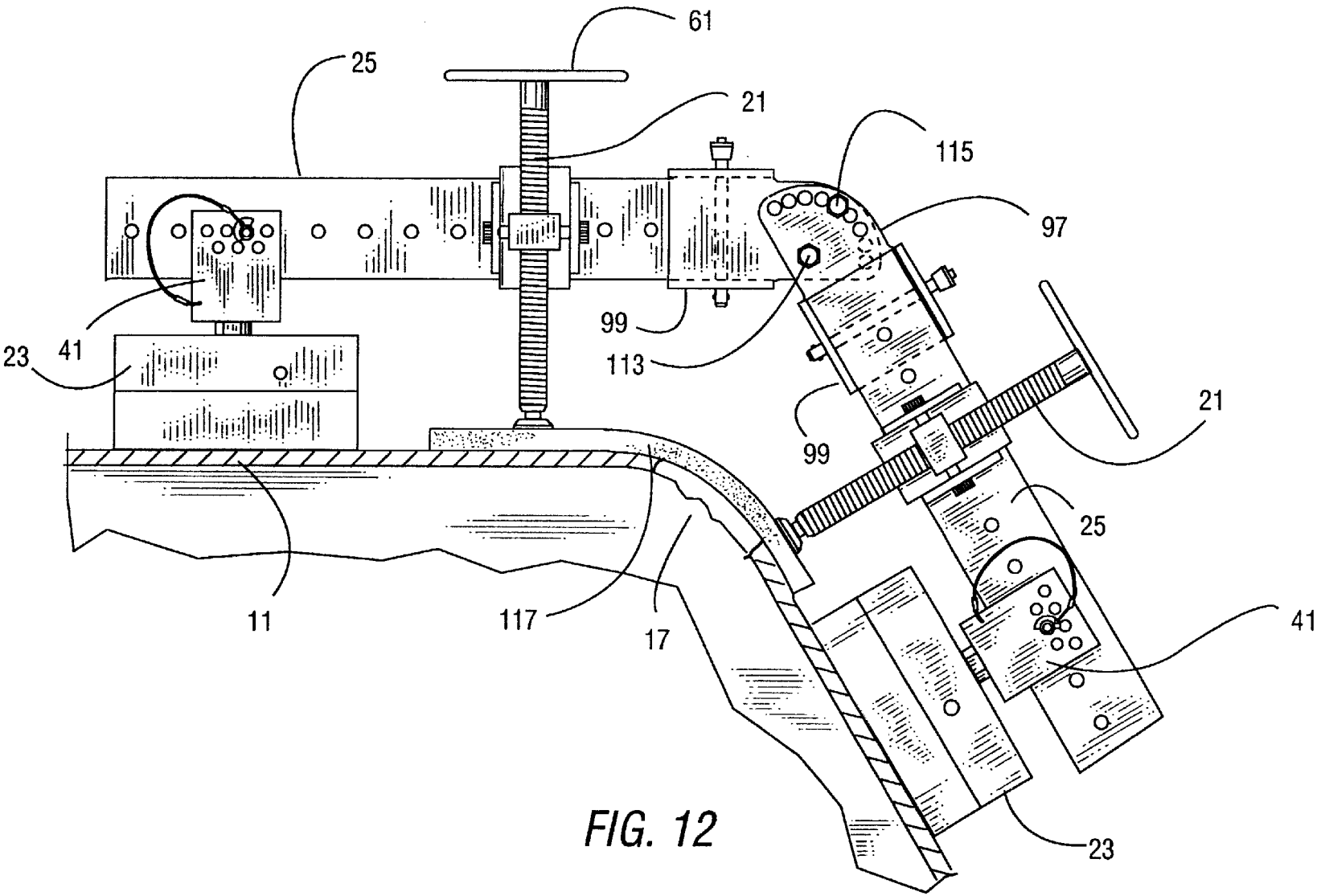
FIG. 12 shows an application of the apparatus, with the adjustable end-to-end coupling located on a curved section of a container wall, using the adjustable end-to-end strongback coupling.
Figure 13:
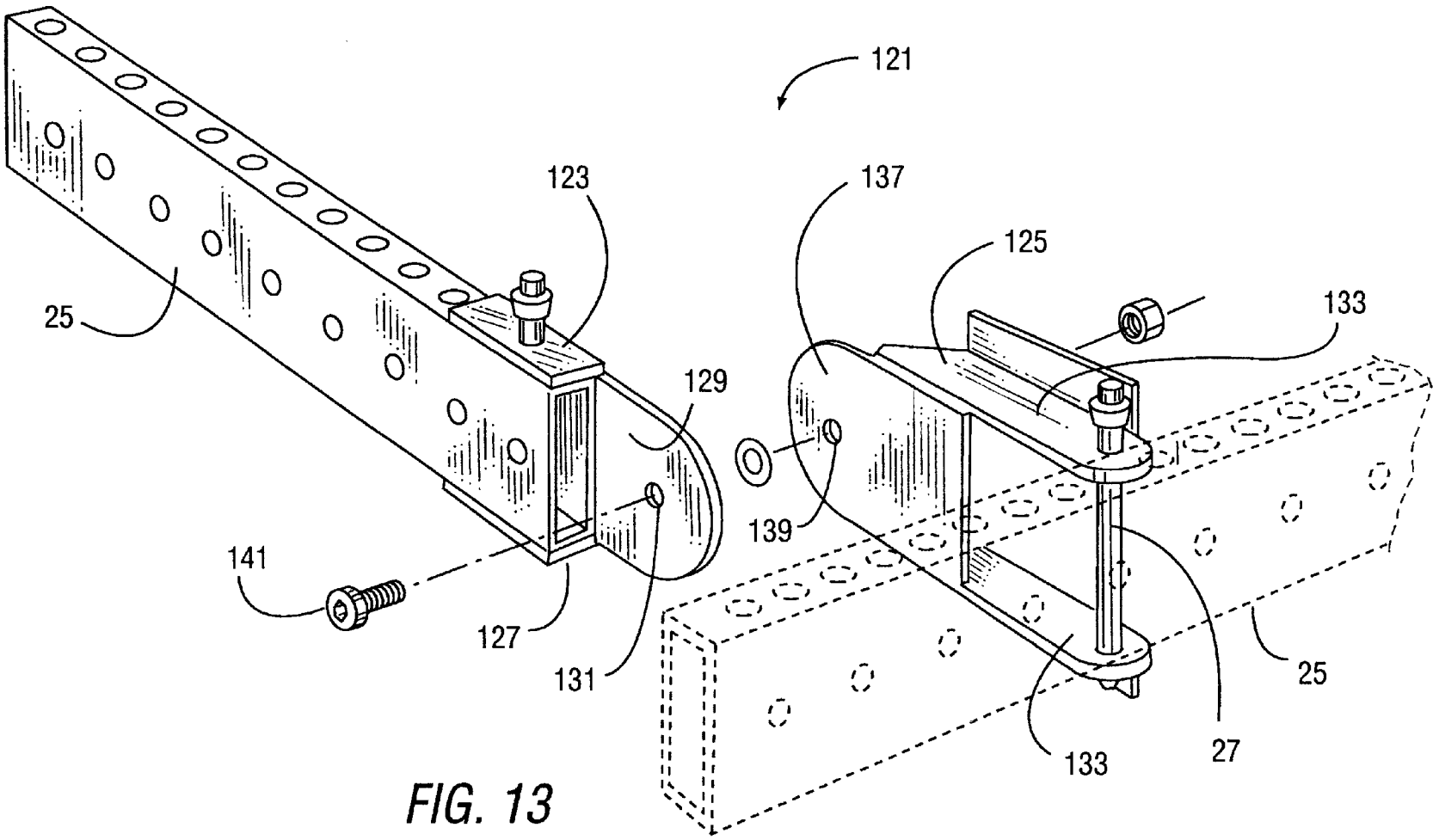
FIG. 13 is an exploded isometric view of the adjustable end-to-intermediate coupling.

Some situations arise where two or more strongbacks 25 need to be coupled together. There are provided several types of strongback couplings. The ends of the strongbacks can be coupled together in a fixed or rigid manner (FIGS. 7 and 8) or in an adjustable manner (FIGS. 9–12). In addition, an end of a strongback can be coupled to an intermediate portion of another strongback (FIGS. 13 and 14). These types of couplings will now be described in more detail.

Figure 8:
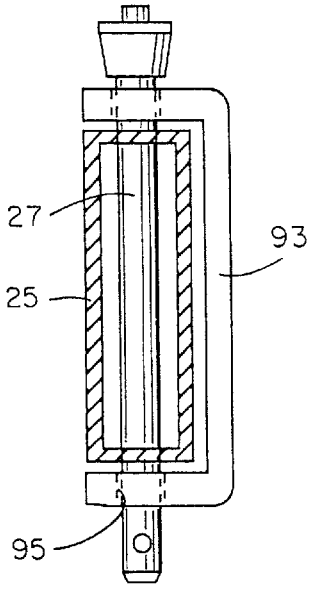
FIG. 8 is a cross-sectional view taken through lines VIII—VIII of FIG. 7.
Figure 7:
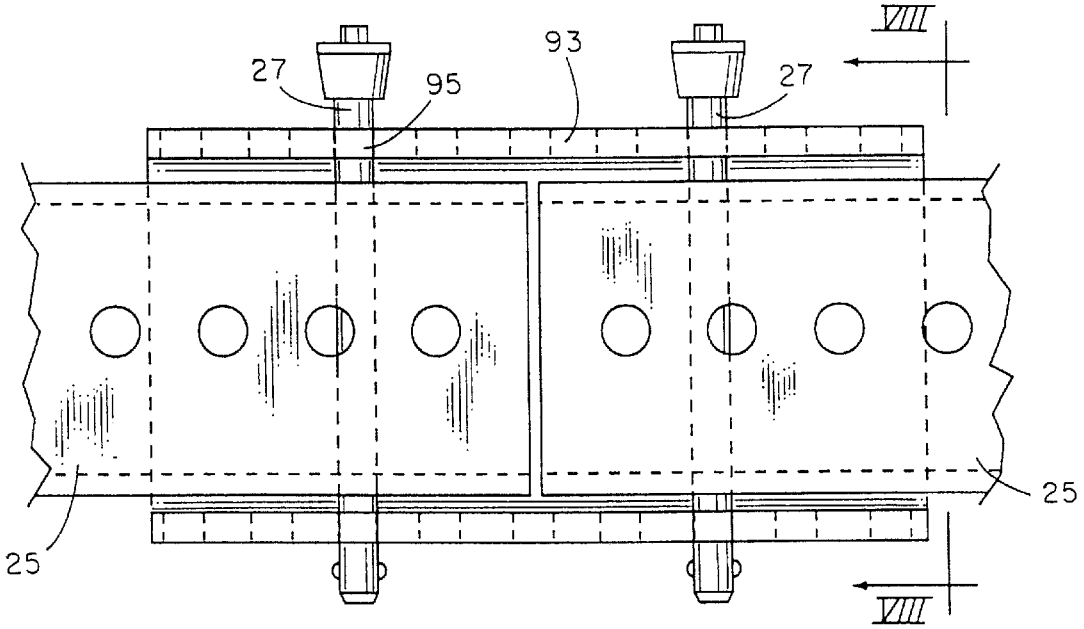
FIG. 7 is a close-up elevational view of a rigid end-to-end strongback coupler.

The rigid end-to-end coupling 93 is shown in FIGS. 7 and 8. The coupling is used to join two strongbacks 25 together in an end-to-end fashion so as to create a longer strongback.

The coupling 93 is a single piece having a "U" shape. Thus, the coupling is shaped like the clamp yoke 63. The sides of the rigid end-to-end coupling 93 are longer however than the clamp yoke 63. There are two sets of aligned holes 95 extending through the two side walls of the coupling 93.

To use the coupling 93, an end of each strongback 25 is located inside one-half of the coupling. Pins 27 extending through the holes 95 in the coupling 93 and the holes 55 in the strongbacks 25 secure the components together.

Other rigid end-to-end couplings can be used. For example, a coupling can have a fixed angle (besides the 0° angle shown in FIG. 7).

The adjustable end-to-end coupling 97 joins the ends of two strongbacks together. This allows the framework to be lengthened and also allows the framework to extend around a curve as shown in FIG. 12.

Figure 11:
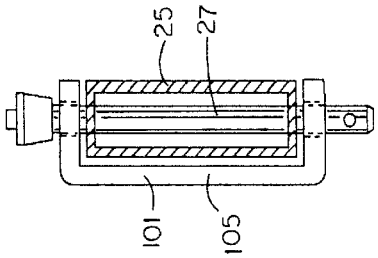
FIG. 11 is a cross-sectional view of the coupling of FIG. 10, taken through lines XI—XI.
Figure 9:
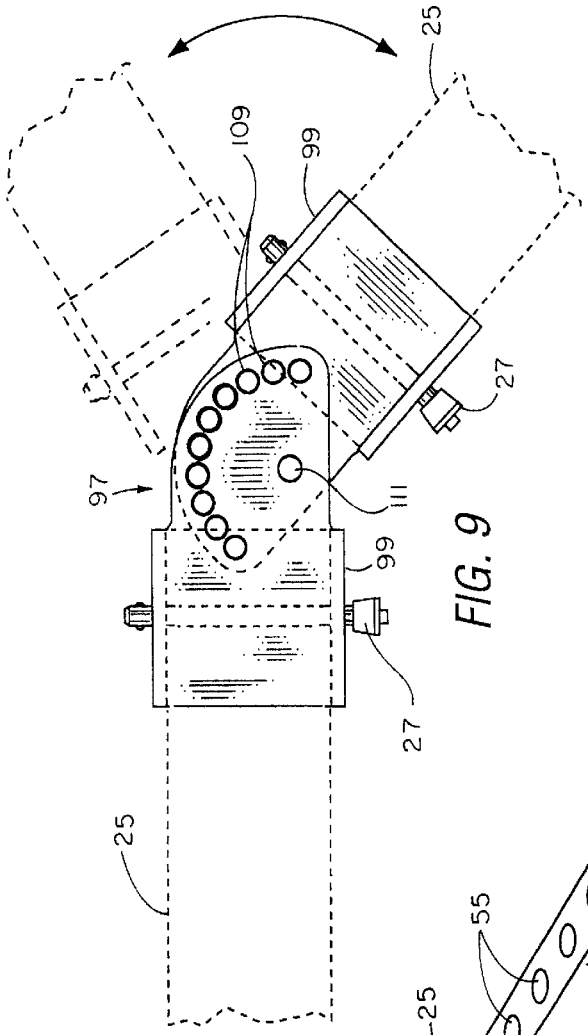
FIG. 9 is an elevational view of an adjustable end-to-end strongback coupling.
Figure 10:
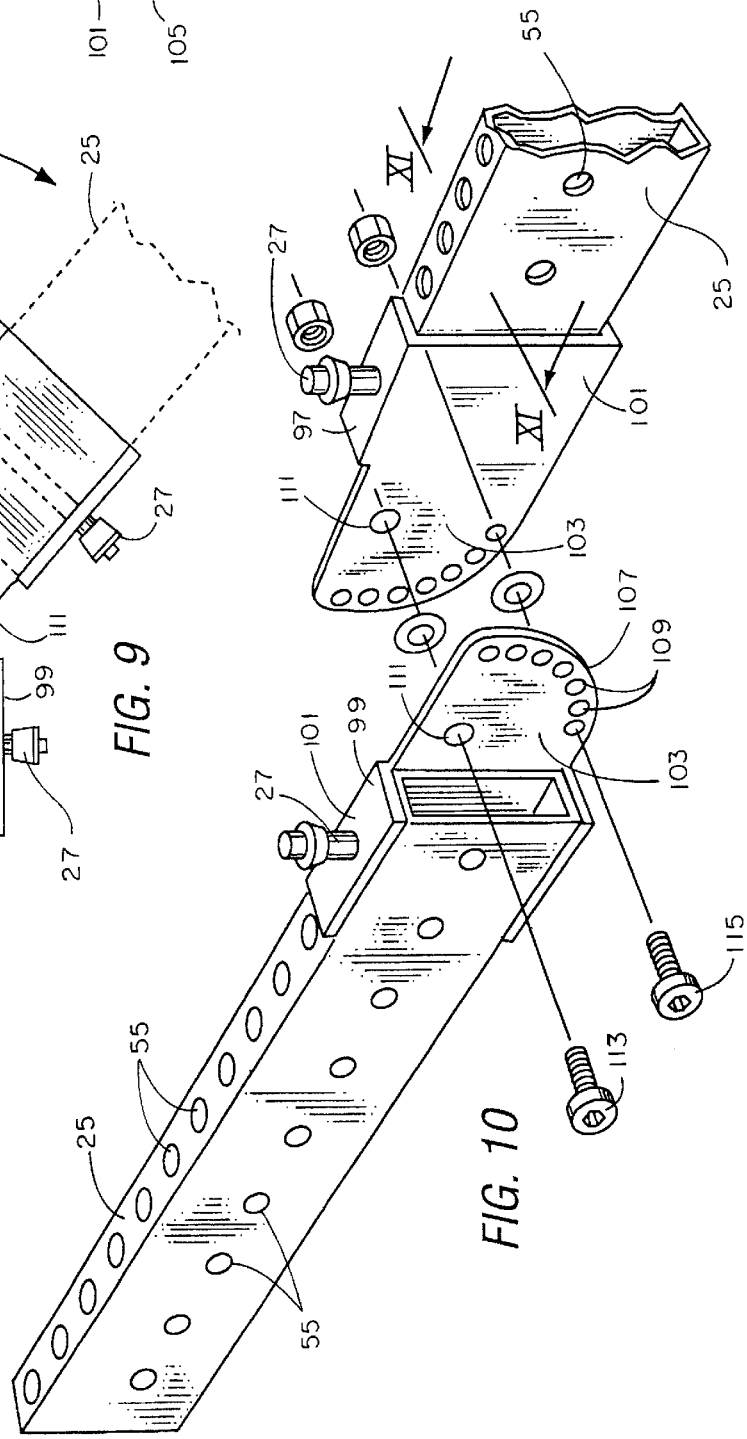
FIG. 10 is an exploded isometric view of the coupling of FIG. 9.

Referring to FIGS. 9–11, the coupling 97 is actually made up of two identical members 99. Each member 99 has a yoke 101 that is substantially similar to the yoke 63 of the clamp. In addition, each member 99 has a plate 103 that extends in a coplanar manner from the main portion 105 of the yoke 63. The plate 103 has an arcuate edge 107 that extends for 90°. A number of holes 109 are formed in the plate adjacent to and following the arcuate edge 107. The holes 109 form a 90° arc. At the apex of the arc is a pivot hole 111.

Each coupling member 99 is mounted to the end of a strongback 25 by way of a pin 27 extending through openings in the yoke 101 and corresponding openings in the strongback. In order to avoid interference, the strongback ends do not cover the holes 109, 111.

Two strongbacks 25 are coupled together as follows: the ends containing the coupling members 99 are located adjacent to each other with the yokes 101 opened in opposite directions from each other, as shown in FIG. 10. Then, the plates 103 are put together so that the pivot holes 111 are aligned and a bolt 113 or pin is put through the aligned holes 111. The angle of the strongbacks 25 is adjusted. At least one of the holes 109 in one member 99 aligns with at least one of the holes 109 in the other member 99. A bolt 115 or pin is then put through the aligned holes, thus fixing the angle of the coupling. The bolts 113, 115 are secured with nuts. Washers are placed on the bolts 113, 115 between the plates 103. Also, in the preferred embodiment, the bolt 113 can be left secured to the plates 103 so as to pivotally couple the members 99 together.

The adjustable end-to-end coupling 97 can be used in a situation as shown in FIG. 12 where the leak is located on or near a curved section of a container. The two magnet pods 23 are not coplanar to one another. In addition, the coupling allows a longer framework to be utilized, wherein the distance between the magnet pods is increased.

To install the framework of FIG. 12, the magnet pods 23 are located on opposite sides of the leak. The two strongbacks are coupled together with a single bolt 113 in the pivot holes 111. The other ends of the strongbacks 25 are located in the yokes 41 of the magnet pods 23. The magnet pod yokes 41 are then pinned to the strongbacks 25. The coupling 97 is secured with the bolt 115 through the aligned holes 109. A patch 117 is put over the leak 17 and secured with one or more clamps 21 as shown in FIG. 12. The leak in FIG. 12 is longer than the point leak of FIG. 2.

Another type of coupling 121 is shown in FIGS. 13 and 14. This coupling is an adjustable end-to-side intermediate coupling 121. The coupling 121 has two members, namely an end member 123 and an intermediate member 125. The end member 123 has a yoke 127 that is substantially similar to the yoke 63 of the clamp 21. Extending out from the main portion of the yoke is a plate 129 having a rounded edge. The plate 129 has a hole 131 therein. The intermediate member 125 has two spaced apart parallel arms 133 that form a yoke for receiving a strongback 25. The arms 133 are made of a bent 90° sheet. The end of each arm 133 has an opening 135 for receiving a pin 27. A plate 137 couples the two arms 133 together. The plate 137, which extends in a direction that is parallel to the arms and out beyond the arms, is coupled to an edge of each arm. The portion of the plate that extends out beyond the arms has a rounded edge and a hole 139 through the plate.

The end member 123 is coupled to the end of a first strongback 25 with a pin 27, such that the plate 129 extends out from the first strongback. The intermediate member 129 is coupled to an intermediate portion of a second strongback with a pin through the arms and the strongback. The plate 137 extends out in a generally perpendicular direction from the strongback. The plate 137 can pivot about the pin 27 to form an adjustable angle with respect to the strongback (for example, 30–150°).

The end member 123 is coupled to the intermediate member 125 by a bolt 141 extending through both holes 131, 139 in the plates. A washer is placed on the bolt between the plates. The angle of the first strongback with respect to the second strongback can be adjusted because the end member can pivot about the bolt 141 with respect to the intermediate member. An exemplarity application of a framework formed by the end-to-intermediate coupling 121 and using two strongbacks is shown in FIG. 14. A plural number of clamps 21 can be coupled to the strongbacks and used to secure the patch.

In the preferred embodiment, the present invention is provided in a kit form, which kit contains plural strongbacks 25, magnet pods 23, clamps 21 and couplings 93,97,121. The kit allows the construction of various types of frameworks, so that various types of leaks can be patched. The flexibility of building a framework for a variety of leak situations greatly enhances the usefulness of the apparatus. In addition, the framework can be constructed quickly and easily. The design minimizes the need to align components for coupling together; the components have a plurality of holes for aligning with each other. Because the framework can be assembled quickly and easily, the leak can be plugged much more quickly than with existing prior art devices.

Figure 15:
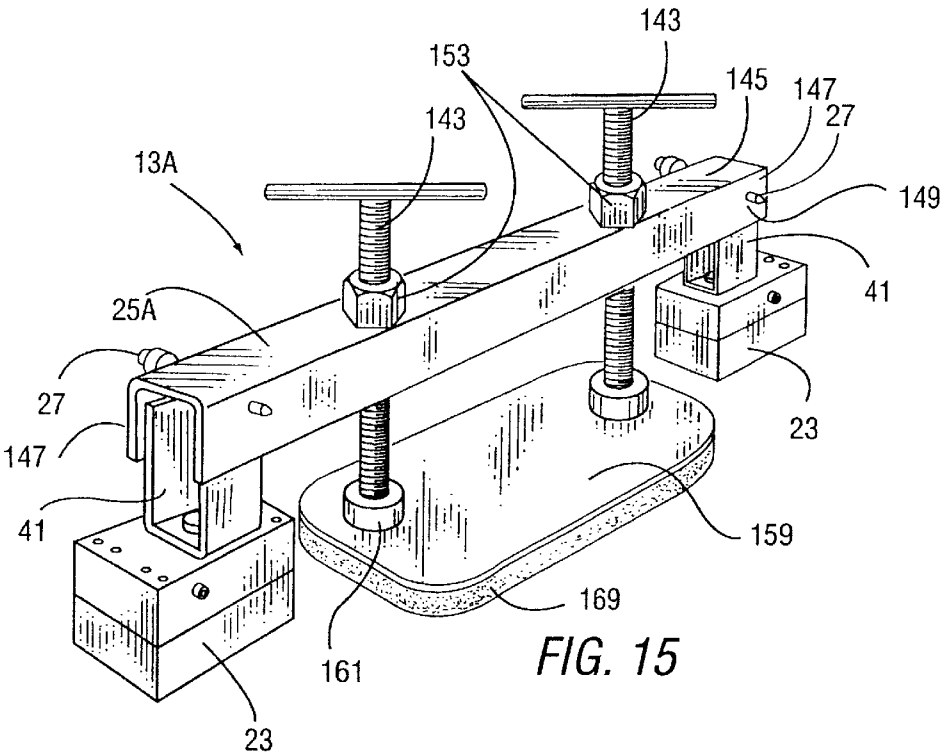
FIG. 15 is a perspective view of the apparatus, in accordance with another embodiment, utilizing two magnet pods.
Figure 16:
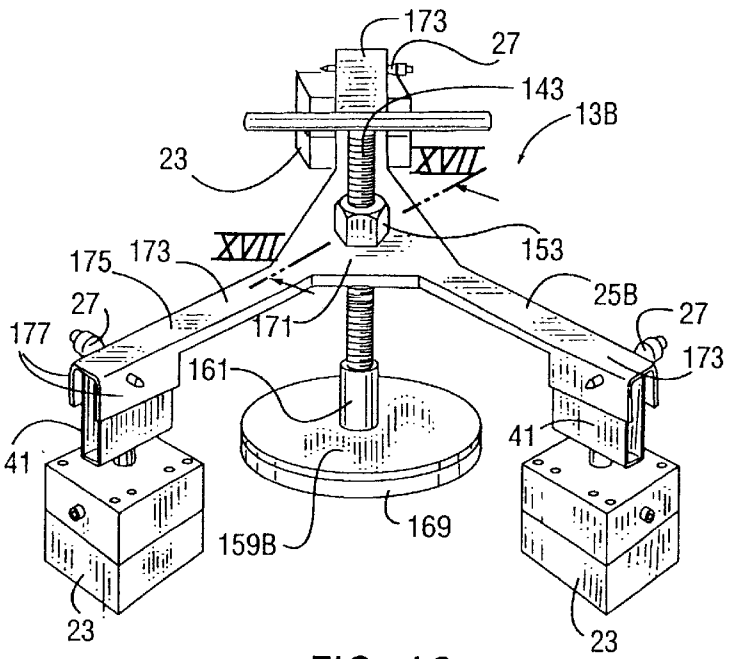
FIG. 16 is a perspective view of the apparatus, in accordance with another embodiment, utilizing three magnet pods.

In FIGS. 15 and 16 there are shown other embodiments of 13A, 13B of the apparatus. These embodiments are used in particular situations. The components that make up these two embodiments could be added to the kit of strongbacks, magnet pods, clamps and couplings.

The embodiments 13A, 13B shown in FIGS. 15 and 16 can be used in certain commonly found situations. For example, the embodiment 13A of FIG. 15 can be used to plug or stop a leak eminating from a relatively small crack or gash in a container. For example, the patch could be 1–2 feet in length. The embodiment 13B of FIG. 16 can be used for small leaks such as pinhole leaks. For example, the patch could be 6–12 inches in diameter.

The embodiments of FIGS. 15 and 16 utilize the magnet pods 23 of the other, previously described, embodiments.

The strongbacks, 25A, 25B, or beams, and the clamps 143 differ from the previously described embodiments. Providing unique strongbacks 25A, 25B, that differ both structurally and in appearance from the other strongbacks 25, allows an operator to quickly select the proper strongback for the particular need or situation from the various strongbacks provided in a kit. For example, if there is a pinhole leak, then the operator can quickly select the three-legged strongback 25B of FIG. 16. If there is a short crack or gash, then the operator can quickly select the two clamp strongback 25A of FIG. 15.

Referring to FIG. 15, the apparatus includes two magnet pods 23, a strongback 25A and two clamps 143.

The strongback 25A is a beam having a transverse cross-section in the shape of an upside down "U". Thus, there is a top wall 145 and two side walls 147 (referring to the orientation shown in FIG. 15). The distance between the two side walls 147 is such that the yoke 41 of a magnet pod 23 can be inserted therebetween. Each end portion of the strongback 25A has an aligned set of holes 149 extending through the side walls for receiving a pin 27.

Figure 17:
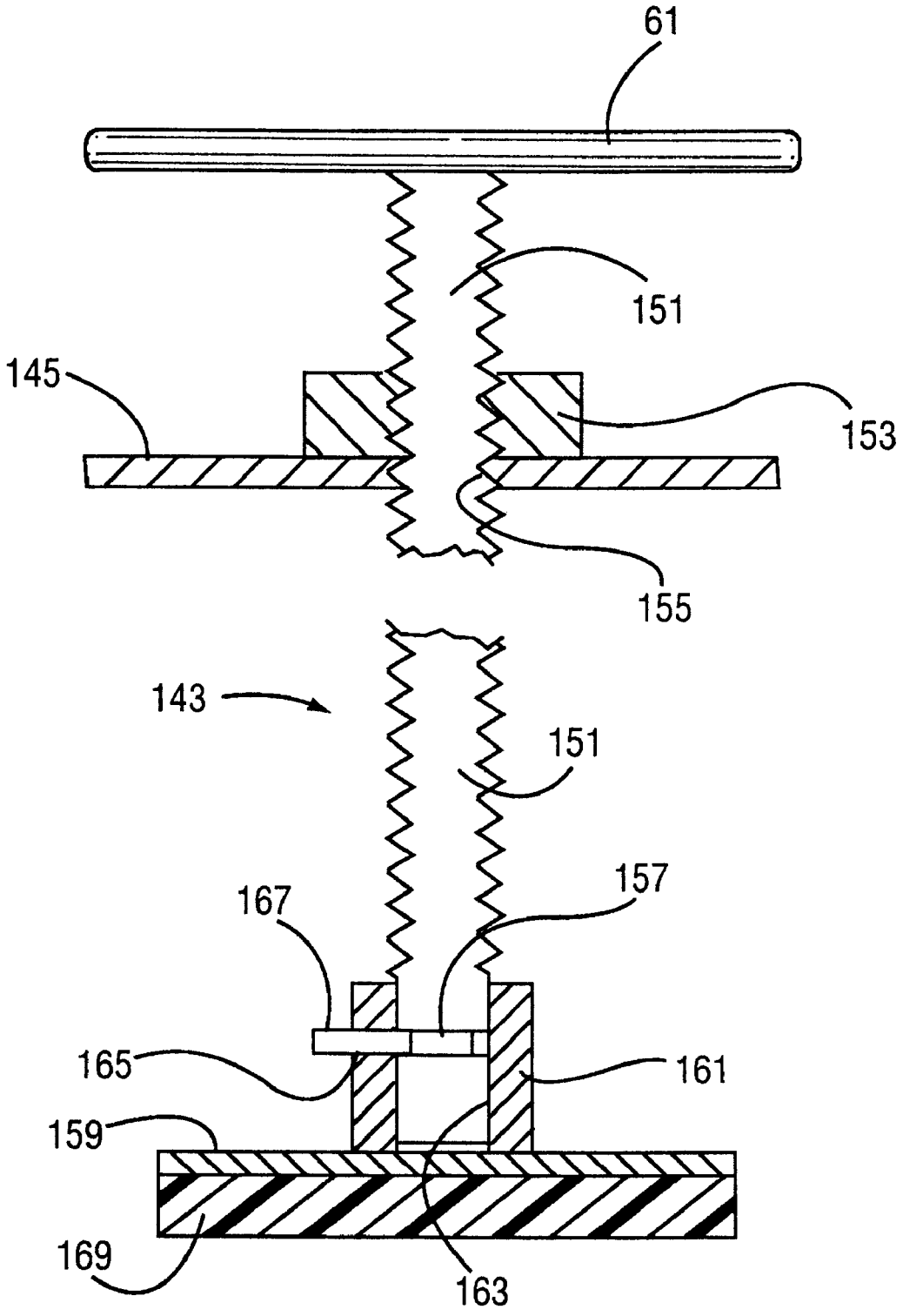
FIG. 17 is a cross-sectional view of the clamp attachments, taken through lines XVII—XVII of FIG. 16.

Referring to FIG. 17, each clamp 143 includes a threaded rod 151 with two end portions. One end portion has a handle bar 61 thereon. A nut 153 is welded or otherwise coupled to the top wall 145 of the strongback. The nut 153 is aligned with an opening 155 in the top wall 145. The threaded rod 151 is threaded through the nut 153. The other end portion has a circumferential groove 157 therein. The other end portion of the threaded rod is coupled to a plate 159 or foot. The plate 159 has on one side, for each clamp, a circular fitting 161. The fitting 161 is welded, or otherwise coupled, to the plate 159. The fitting 161 has a circular bore 163 therein that receives the other end of the threaded rod 151. The fitting 161 has a hole 165 therethrough, which hole aligns with the groove 157 in the threaded rod. A spring loaded pin 167 extends through the hole 165 and into the groove 157 to retain the threaded rod inside of the fitting. The threaded rod 151 can rotate inside of the fitting 161. Alternatively, a set screw can be used. The set screw should be loose so as to allow the threaded rod to rotate in the fitting. As still another alternative, the threaded rod 151 can be coupled to the plate 159 with a ball and socket joint, much like what is shown in FIG. 5 (between pieces 57 and 59).

In the embodiment of FIG. 15, there are two clamps 143 and thus two threaded rods 151. The plate 159 is generally rectangular, with a threaded rod or clamp located near each end of the plate.

The plate 159 overlies a similarly sized and shaped piece of rubber or other elastomeric patch material 169. An adhesive can be used to secure the patch to the plate.

In order to speed the ability to plug a leak, the clamps 143 and plate 159 are already assembled onto the strongback 25A before use. To assemble the strongback and clamps together, the threaded rods 151 are threaded into the nuts 153. The other ends of the threaded rods are received by the fittings 161 on the plate 159. The pins 167 are retracted during the insertion of the threaded rods and then allowed to engage the respective groove 157. The patch material can be bonded to the plate.

In operation, the magnet pods 23 are positioned on either side of the leak so as to be coupled to the container wall. The ends of the strongback are then placed over the respective yokes 41 of the magnet pods 23. At each end of the strongback, the holes 149 are aligned with one set of holes in the yoke 41 and the pin 27 is inserted therethrough. This couples the strongback to the respective magnet pod. Then, the handles 61 are turned to bring the patch 169 into contact with the container wall. The clamps are tightened until the leak is stopped.

When the apparatus is ready to be removed, the magnet pods 23 are removed from the container with the camming tool 83.

The embodiments of FIGS. 15 and 16, much like the embodiment of FIGS. 2 and 3, provide a connection between the strongback and the magnet pod yoke that is easy to assemble and couple together. The yoke has side walls that are made to slidingly contact the side walls of the beam. Thus, the beam can be dropped into the yoke (as in FIGS. 2 and 3) or laid over the yoke (as in FIGS. 15 and 16). Either way, once the yoke receives the beam (or the beam receives the yoke), the beam can be slid with respect to the yoke to couple to the other magnet pod yoke. Then the holes are aligned between the beam and yoke and the pin 27 is inserted.

In the embodiment 13B shown in FIG. 16, the strongback has a center portion 171 with three legs 173 extending out therefrom. The end of each leg 173 is shaped like an upside down "U". Thus, the end of each leg has a top wall 175 and two side walls 177. The side walls 177 need not extend to the center portion. The top walls 175 do extend to the center portion. The nut 153 is located in the center portion 171.

The embodiment of FIG. 16 utilizes a single clamp 143 and three magnet pods 23. The end of each leg 173 is coupled to a magnet pod yoke 41 with a pin 27. The clamp 143 is rotatably coupled to a circular plate 159B, with a patch 169 underneath. The use of the embodiment 13B of FIG. 16 is the same as the embodiment 13A of FIG. 15.

The plates 159, 159B can be flat or radiused. For example, if the plate is to be used on a railcar tank, the plate can be radiused to the curvature of the tank. This assists in stopping the leak.

Figure 19:
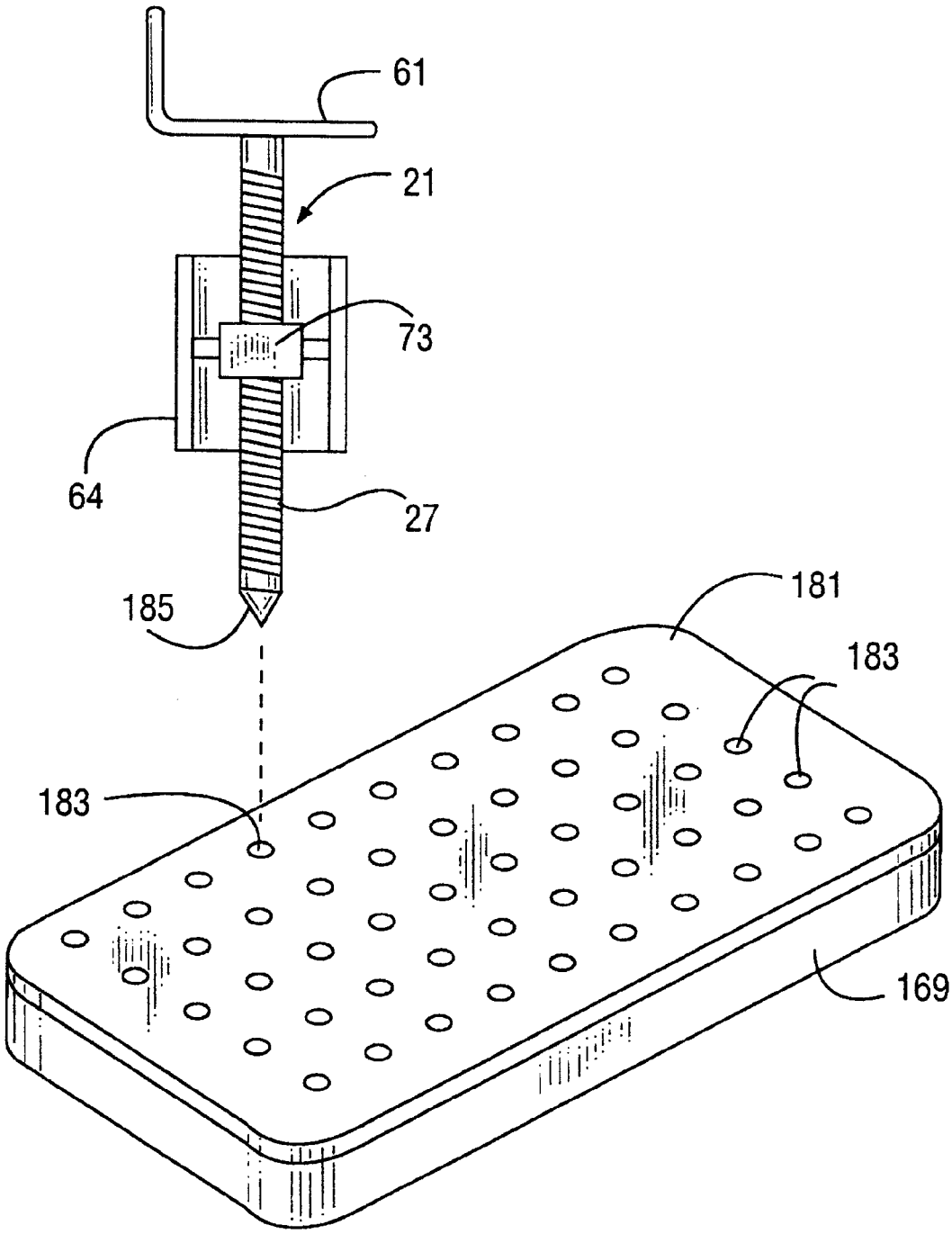
FIG. 19 is an isometric view of a patch, shown with a clamp, in accordance with another embodiment.

FIG. 19 shows another embodiment of the clamp coupling to the plate. The plate 181 has a plurality of small holes 183 therethrough. The end 185 of the threaded rod 57 of the clamp 21 is conical so as to fit within any one of the holes. The diameter of the holes 183 is smaller than the diameter of the rod end 185. In the preferred embodiment, the holes 183 penetrate through the plate. Alternatively, depressions in the plate can capture the end 185.

The plate 181 is provided with the elastomeric patch 169, which is held to the plate by adhesive.

During installation of the apparatus, the plate 181 and patch 169 are positioned to cover the leak. One or more clamps 21 are secured to the strongback and the threaded rods 27 and rotated to advance toward the plate. The conical end 185 of each rod 27 is inserted into a hole 183 and the clamp is tightened to secure the patch. The clamp need not be perpendicular to the plate, but can be at some other angle; the end 185 will still be captured by the hole 183.

The plate 181, and the corresponding patch 169, can be a variety of shapes such as square, rectangular, circular, etc. The plate need not be flat, but can be curved or even angled to follow the contours of the container wall.

Figure 20:
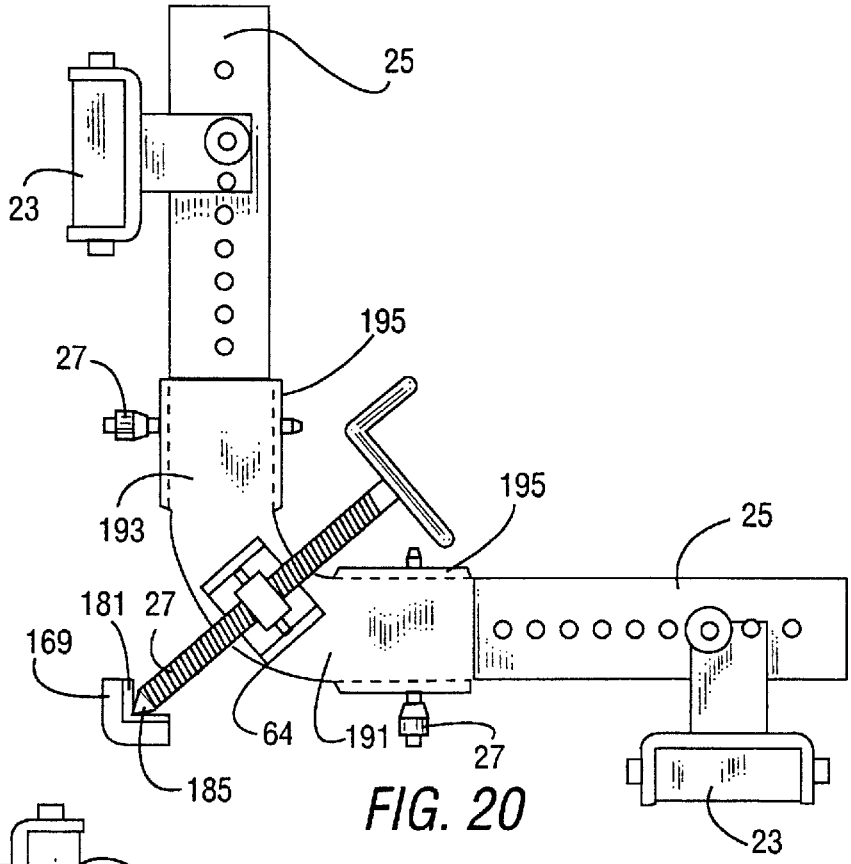
FIG. 20 is a plan view of the apparatus used to plug a leak in an inside corner.
Figure 21:
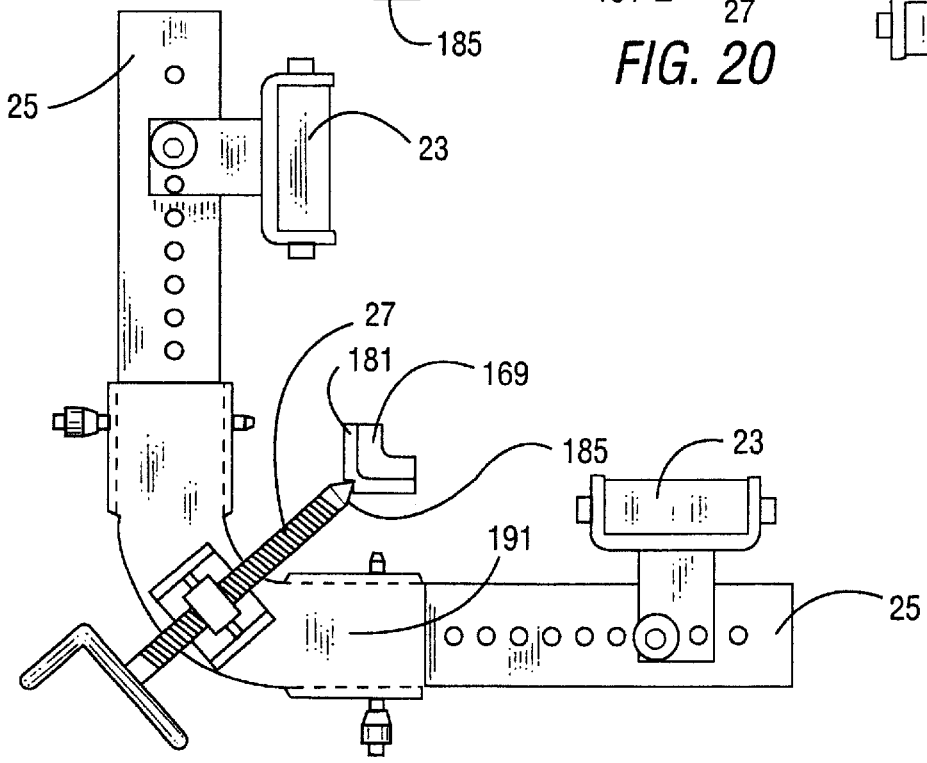
FIG. 21 is a plan view of the apparatus used to plug a leak on an outside corner.

In FIGS. 20 and 21, the plate 181 is angled. In FIG. 20, the patch is located on the outside of the angled plate; the patch is used for a leak in an inside corner of a container. In FIG. 21, the patch is located on the inside of the angled plate; the patch is used for a leak on an outside corner of a container. FIGS. 20 and 21 illustrate the use of a rigid end-to-end coupling 191. In the embodiment shown, the coupling 191 joins the ends of the two strongbacks together at a 90° angle. The coupling has a plate 193 that is, in plan view, shaped like an "L" with two legs of equal length. Each leg has a yoke 195 to receive an end of a strongback, which is secured by a pin 27. The side of the plate 193 opposite of the yokes has a rotating yoke 64 for the threaded rod 27 of the clamp. The threaded rod is coupled to the yoke 64 as described above with respect to FIG. 5.

To stop a leak on an inside corner of a container, FIG. 20, magnet pods 23 are positioned on each side of the leak. Two strongbacks, joined together at a right angle, with a rigid end-to-end coupling 191 are positioned and then secured to the magnets as described above. The threaded rod 27 is rotated with respect to the end-to-end coupler so as to point the conical end toward the leak. The angled patch and plate are positioned in the comer. The threaded rod is advanced to insert the conical end 185 into a hole in the plate (there are holes along the corner of the plate) and then tightened to secure the patch.

FIG. 21 illustrates an outside corner patch, wherein the threaded rod is rotated to the opposite orientation from that shown in FIG. 20.

The foregoing description and the showings made in the drawings are merely illustrative of the principles of this invention and are not to be interpreted in a limiting sense.

What is claimed is:

1. An apparatus for use in stopping a leak in a ferromagnetic wall of a container, comprising:

a) at least two magnet pods, with each magnet pod comprising a magnet having a surface that is structured and arranged for contacting the container wall, and a member rotatably coupled with the magnet, the member having plural holes therethrough;

b) a beam having plural holes therethrough, the beam being coupled to each of the members when one of the holes of the respective one of the members aligns with one of the holes in the beam so as to receive a pin through the aligned holes;

c) a clamp having a foot and being coupled to a selected location along the length of the beam, the position of the foot with respect to the beam being adjustable so as to apply clamping pressure to the wall when the apparatus is installed on the wall.

2. The apparatus of claim 1 wherein the member comprises a yoke having plural holes therethrough.

3. The apparatus of claim 2 wherein the yoke is coupled with the magnet such that the yoke can rotate and roll with respect to the magnet.

4. The apparatus of claim 1 wherein the beam is rectangular in transverse cross-section and having four sides, with each side having a line of holes therein, with the holes on one side being aligned with the holes on the opposite side.

5. The apparatus of claim 1 wherein the beam comprises a first beam and a second beam, with each of the first and second beams having two ends, one of the ends of the first beam being coupled to one of the ends of the second beam with a rigid coupling.

6. The apparatus of claim 5 wherein the rigid coupling is "U" shaped having a main portion and sides extending from the main portion, the sides having holes therethrough for receiving pins.

7. The apparatus of claim 1 where the beam comprises a first beam and a second beam, with each of the first and second beams having two ends, one of the ends of the first beam being coupled to one of the ends of the second beam with an adjustable coupling, wherein the angle between the first and second beams can be adjusted.

8. The apparatus of claim 7 wherein the adjustable coupling comprises first and second end pieces, with the first end piece being coupled to one of the ends of the first beam and the second end piece being coupled to one of the ends of the second beam, the first and second end pieces each comprising a plate having a pivot hole and an arc of holes, the plates being pivotally coupled together at the pivot holes, wherein at least one hole in the arc of holes of one plate is aligned with at least one hole in the arc of holes of the other plate so as to receive a pin coupling.

9. The apparatus of claim 1 wherein the beam is a first beam, the first beam having an intermediate portion, further comprising a second beam having two ends, with one of the ends of the second beam being coupled to the intermediate portion of the first beam with an adjustable coupling, wherein the angle between the first and second beams can be adjusted, and with the other of the ends of the first beam being coupled to a third magnet pod.

10. The apparatus of claim 9 wherein the adjustable coupling comprises first and second pieces, with the first piece being pivotally coupled to the intermediate portion of the first beam and the second piece being coupled to one of the ends of the second beam, the first and second pieces being pivotally coupled together.

11. The apparatus of claim 1 further comprising a patch, the patch comprising a rigid member and an elastomeric member, the rigid member having a plurality of depressions for receiving the foot of the clamp.

12. An apparatus for use in stopping a leak in a ferromagnetic wall of a container, comprising:

a) at least two magnet pods, with each magnet pod comprising a magnet having a surface that is structured and arranged for contacting the container wall, and a member rotatably coupled to the magnet;

b) first and second beams with each of the first and second beams having two ends, one of the ends of the first beam being coupled to one of the magnet pods and one of the ends of the second beam being coupled to another of the magnet pods, the first and second beams being coupled together;

c) a clamp having a foot and being coupled to a selected location along the length of one of the first or second beams, the position of the foot with respect to one of the first or second beams being adjustable so as to apply clamping pressure to the wall when the apparatus is installed on the wall.

13. The apparatus of claim 12 wherein the other of the ends of the first beam is coupled to the other of the ends of the second beam with a rigid coupling.

14. The apparatus of claim 13 wherein:

a) the first and second beams have holes therethrough for receiving pins;

b) the rigid coupling is "U" shaped having a main portion and sides extending from the main portion, the sides having holes therethrough for receiving pins.

15. The apparatus of claim 12 wherein the other of the ends of the first beam being coupled to the other of the ends of the second beam with an adjustable coupling.

16. The apparatus of claim 15, wherein:

a) the first and second beams have holes therethrough for receiving pins;

b) the adjustable coupling comprises first and second end pieces, with the first end piece being coupled to the other of the ends of the first beam and the second end piece being coupled to the other of the ends of the second beam, the first and second end pieces each comprising a plate having a pivot hole and an arc of holes, the plates being pivotally coupled together at the pivot holes, wherein at least one hole in the arc of holes of one plate is aligned with at least one hole in the arc of holes of the other plate.

17. The apparatus of claim 12 wherein:

a) the other of the ends of the second beam is coupled to an intermediate portion of the first beam with an adjustable coupling;

b) the other of the ends of the first beam is coupled to a third magnet pod.

18. The apparatus of claim 17 wherein the adjustable coupling comprises first and second pieces, with the first piece being pivotally coupled to the intermediate portion of the first beam and the second piece being coupled to the other of the ends of the second beam, the first and second pieces being pivotally coupled together.

19. A method of stopping a leak in a ferromagnetic wall of a container, comprising the steps of:

a) providing at least two magnet pods, with each magnet pod having a member extending therefrom, each member having plural holes therethrough;

b) providing a beam having plural holes therethrough, the beam holes being located along a length of the beam;

c) contacting one of the magnet pods with the container wall on one side of the leak and contacting another of the magnet pods with the container wall on another side of the leak;

d) placing the beam between the magnet pods;

e) at each magnet pod, aligning at least one of the holes in the respective member with at least one of the holes in the beam and inserting a pin through the aligned holes to couple the beam to the respective magnet pod;

f) coupling an extendible arm to the beam, the extendable arm having a foot thereon, the foot being located adjacent to the leak;

g) locating a patch on the leak;

h) extending the arm from the beam so that the foot applies pressure to the patch.

20. The method of claim 19 further comprising the step of constructing the beam from first and second beams that are coupled together in an end-to-end manner with a rigid coupling.

21. The method of claim 19 further comprising constructing the beam from first and second beams that are coupled together in an end-to-end manner with an adjustable angle coupling.

22. The method of claim 19 further comprising the step of constructing the beam from first and second beams, with an end of the second beam being pivotally coupled to an intermediate portion of the first beam, the second beam being coupled to one of the magnet pods and the first beam being coupled to two other of the magnet pods on either side of the intermediate portion.

23. An apparatus for use in stopping a leak in a ferromagnetic wall of a container, comprising:

a) at least two magnet pods, with each magnet pod comprising a magnet having a surface that is structured and arranged for contacting the container wall, and a member rotatably coupled with the magnet, the member having two spaced apart wall surfaces;

b) a beam comprising two end portions, with each portion having two spaced apart wall surfaces, each of the end portions of the beam being removably coupled to a respective one of the magnet pod members at a connection;

c) at each connection, either one of the member wall surfaces or the beam end portion wall surfaces having a cavity therebetween for receiving the other of the member wall surfaces where the beam end portion wall surfaces;

d) at each connection, either of the member wall surfaces or the beam end portion wall surfaces having plural sets of holes therethrough, with the other of the member wall surfaces or the beam end portion wall surfaces having at least one set of holes therethrough, the member and the beam end portion being coupled together by a pin extending through aligned holes in the member and the beam end portion;

e) a clamp that is sealingly coupled to the beam at a location that is between the magnet pods, the clamp being rotatably coupled to a foot, the foot being structured and arranged to contact a patch.

24. The apparatus of claim 23 wherein the member comprises a transverse wall that couples the member wall surfaces together.

25. The apparatus of claim 23 wherein the beam end portions each comprise a transverse wall that couples the beam end portion wall surfaces together.

26. The apparatus of claim 23 wherein the beam has three end portions extending from a center portion, the clamp being threadingly coupled to the center portion.

27. The apparatus of claim 23 wherein the clamp is threadingly coupled to the beam at a fixed location along the beam.

28. The apparatus of claim 23 wherein the clamp is threadingly coupled to the beam at an adjustable location along the beam.

* * * * *